US008789291B2

(12) United States Patent
Reets et al.

(10) Patent No.: US 8,789,291 B2
(45) Date of Patent: Jul. 29, 2014

(54) HEAT EXCHANGER ASSEMBLY WITH AIR MOVER

(75) Inventors: Jeremiah S. Reets, Sharpsburg, GA (US); Gordon K. Hanks, Salt Lake City, UT (US)

(73) Assignee: Bridgewater LLC, Salt Lake City, UT (US)

( * ) Notice: Subject to any disclaimer, the term of this patent is extended or adjusted under 35 U.S.C. 154(b) by 421 days.

(21) Appl. No.: 11/221,435

(22) Filed: Sep. 8, 2005

(65) Prior Publication Data

US 2007/0051007 A1 Mar. 8, 2007

(51) Int. Cl.
*F26B 19/00* (2006.01)
*F26B 17/30* (2006.01)

(52) U.S. Cl.
USPC ..... 34/618; 34/619; 34/621; 34/622

(58) Field of Classification Search
USPC ..... 34/86, 72, 58, 87, 621, 622, 618, 619; 126/101, 110 R
See application file for complete search history.

(56) References Cited

U.S. PATENT DOCUMENTS

| | | | | | |
|---|---|---|---|---|---|
| 2,121,648 | A | * | 6/1938 | Wheaton | 62/411 |
| 3,268,368 | A | | 8/1966 | Thomas | |
| 3,273,193 | A | | 9/1966 | Soderholm et al. | |
| 3,291,495 | A | * | 12/1966 | Liebig | 277/577 |
| 4,033,320 | A | * | 7/1977 | Jury | 126/110 R |
| 4,171,722 | A | * | 10/1979 | Huggins | 55/385.1 |
| 4,562,884 | A | * | 1/1986 | Moller et al. | 165/76 |
| 5,048,202 | A | | 9/1991 | Shero | |
| 5,257,467 | A | * | 11/1993 | White | 34/618 |
| 5,379,525 | A | * | 1/1995 | Raynor | 34/104 |
| 5,606,769 | A | * | 3/1997 | Tomasiak et al. | 15/327.6 |
| 5,619,935 | A | * | 4/1997 | Wilson | 110/241 |
| 5,737,938 | A | * | 4/1998 | Liu | 62/425 |
| 5,797,197 | A | | 8/1998 | Alday | |
| 6,052,861 | A | | 4/2000 | Keller | |
| 6,202,322 | B1 | * | 3/2001 | Turner, IV | 34/618 |
| 6,210,270 | B1 | | 4/2001 | Niksic et al. | |
| 6,551,282 | B1 | * | 4/2003 | Exline et al. | 604/167.01 |
| 6,615,508 | B1 | | 9/2003 | Valle | |
| 6,739,070 | B1 | * | 5/2004 | Jacobs et al. | 34/619 |
| 7,357,831 | B2 | * | 4/2008 | Dancey et al. | 96/400 |
| 2005/0144801 | A1 | | 7/2005 | Wilson | |
| 2005/0217484 | A1 | * | 10/2005 | Bourgault et al. | 95/273 |

FOREIGN PATENT DOCUMENTS

GB 2165349 A * 4/1986

OTHER PUBLICATIONS

Drieaz 2004 Product Catalog, pp. 18, 21, and 22, 2004.
ICS Cleaning Specialists, bnp Media publication, pp. 38-39, Jul. 2005.

* cited by examiner

*Primary Examiner* — Jiping Lu
(74) *Attorney, Agent, or Firm* — Workman Nydegger

(57) ABSTRACT

A heat exchanger assembly includes a housing at least partially bounding a chamber and a heat exchanger at least partially disposed within the chamber, the heat exchanger containing tubing adapted to allow a heated fluid to travel therethrough and fins outwardly projecting from the tubing, the fins being spaced apart such that air can freely flow between the fins. The heat exchanger also includes an inlet port into which an air mover can be received to provide blown air for the system and an outlet port through which the heated air exits the heat exchanger assembly.

35 Claims, 9 Drawing Sheets

HEAT EXCHANGER ASSEMBLY WITH AIR MOVER

CROSS-REFERENCE TO RELATED APPLICATIONS

Not applicable.

BACKGROUND OF THE INVENTION

1. The Field of the Invention

The present invention relates generally to devices and methods for drying out carpets and other structures by blowing heated air. More specifically, the present invention relates to heat exchangers for use with air movers. These systems are primarily designed for drying carpet, floors, walls, and the like when such structures have received water damage such as through flooding or leaks.

2. The Relevant Technology

Most of today's homes use carpeting throughout a large portion of the house. Carpeting is preferred by many homeowners because it cushions the feet while providing a nice look to each room. A foam pad is typically used underneath the carpet to provide extra cushion. Carpeting, however, can be problematic when it receives water damage such as through flooding, roof leakage, plumbing problems, or the like. When this occurs, the carpet, pad, subfloor and surrounding walls can become saturated with water. To minimize the water damage and avoid mold growth, it is necessary to rapidly remove the water. Drying carpet, however, can be especially difficult in that the carpet and pad absorb and hold the water. It can also be difficult to remove the water that has soaked into the subfloor and surrounding walls.

In one conventional process for treating carpet with water damage, the carpet pad is removed and thrown away. An air mover is then used to dry the remaining carpet, subfloor, and walls. Depicted in FIG. 1 is one embodiment of a conventional centrifugal air mover 10 that is electrically operated. Air mover 10 has a body 12 that houses a centrifugal fan 14. A snout 16 projects from body 12 through which the air exits the air mover 10. Centrifugal fan 14 draws ambient air into air mover 10 through an air inlet 9 and then accelerates the air out through snout 16. A handle 13 projects from body 12 and has an opening 15 extending therethrough. It is appreciated that centrifugal air mover 10 can come in a variety of different sizes, shapes, and configurations.

During one conventional operation, snout 16 is slipped underneath an edge of the carpet that has received water damage. Air mover 10 is then operated so that air passing through snout 16 is delivered below the carpet so as to "float" the carpet. As air is continually delivered below the carpet, water in the carpet, subfloor and surrounding walls slowly evaporates into the air. The process is continued until all surfaces are dry. A new pad is then placed below the carpet and the carpet is again secured in place. It is appreciated that the removal, disposal, and replacement of the carpet pad can be both expensive and time consuming.

To provide enough air flow to float and dry a soaked carpet, conventional air movers must blow air at a very high rate. For example, a typical centrifugal air mover blows air at approximately 2,000-3,500 cubic feet per minute (cfm). Also, the rate at which a carpet dries using a air mover is directly proportional to the amount of air that passes by the carpet, which is directly proportional to the output of the air mover. For instance, a air mover that blows at 3,500 cfm delivers more air under the carpet and will thus dry the carpet faster than a air mover that blows air at 2,500 cfm.

One common problem with conventional air movers is that because the air movers are simply blowing surrounding air that is at ambient temperature and humidity, the air movers can take an extended period of time to dry the carpet, subfloor, and walls. This is particularly true where the drying is occurring in a humid and/or cold environment. In part, the carpet pad is often simply thrown away because it takes so long to dry using conventional air movers as to be impractical.

In one attempt to address the above problem, an air mover has been developed that uses an electrical element to heat the air passing through the snout. While this may be an improvement over the prior art, there are some shortcomings. For example, U.S. Pat. No. 6,202,322 to Turner discloses an air mover that includes heating coils in the snout that can produce up to 20,000 to 50,000 BTUs to heat the exiting air. However, because the air is coming out of the snout at such a high rate, the heating element only marginally heats the air as it blows past the heating elements. Thus any effect on drying is marginal. Furthermore, conventional air movers are ubiquitous among the many companies that perform water damage restoration. Use of air movers having electrical heating elements would require them to purchase all new air movers.

In view of the foregoing, it would be desirable to have systems that could dry carpet, subfloors, walls, and other structures quicker than conventional air movers and that can be efficiently used in cold and/or humid environments. Likewise, it would be beneficial to have systems that could rapidly dry carpet and carpet pad without having to remove the carpet pad from below the carpet. Additionally, it would be beneficial if such systems could be used with convention air movers which are already extensively used so that the air movers would not have to be replaced.

BRIEF DESCRIPTION OF THE DRAWINGS

Various embodiments of the present invention will now be discussed with reference to the appended drawings. It is appreciated that these drawings depict only typical embodiments of the invention and are therefore not to be considered limiting of its scope.

DETAILED DESCRIPTION OF THE PREFERRED EMBODIMENTS

Figure 1:
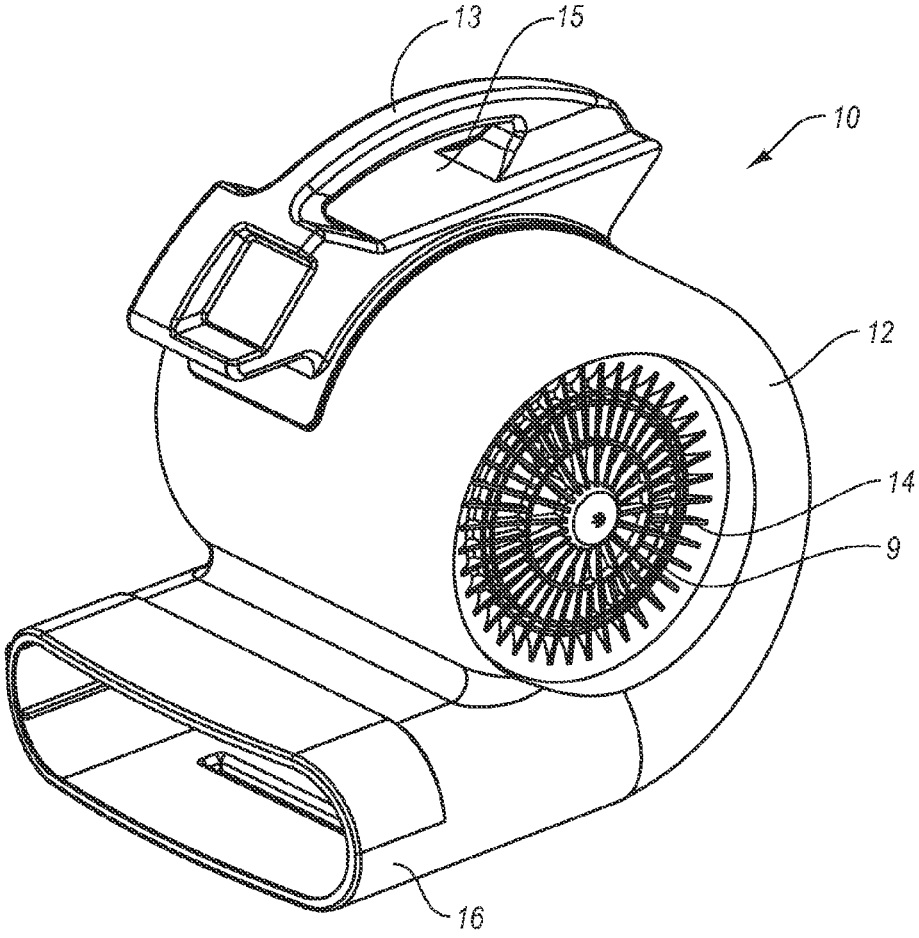
Fig. 1 (Prior Art)
FIG. 1 is a perspective view of a conventional centrifuigal air mover.
Figure 2:
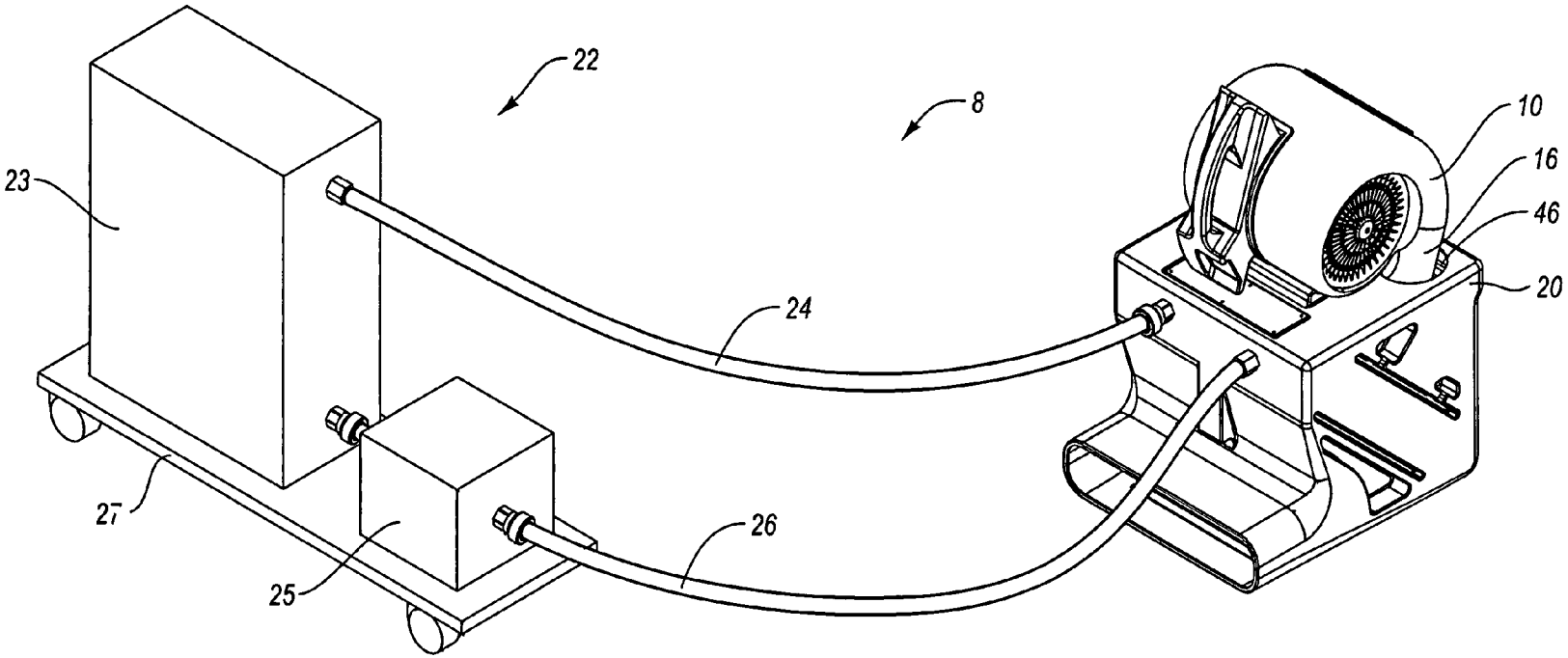
FIG. 2 is a perspective view of an inventive carpet drying system incorporating the centrifugal air mover of FIG. 1.

Depicted in FIG. 2 is one embodiment of an inventive carpet drying system 8 incorporating features of the present invention. The system 8 is designed to rapidly dry carpet and other surfaces that have been flooded or otherwise soaked with water by heating air and then blowing the heated air across the wetted surface. The air can be blown over, under, or about the surface, such as over a wood floor or under a carpet.

Figure 3:
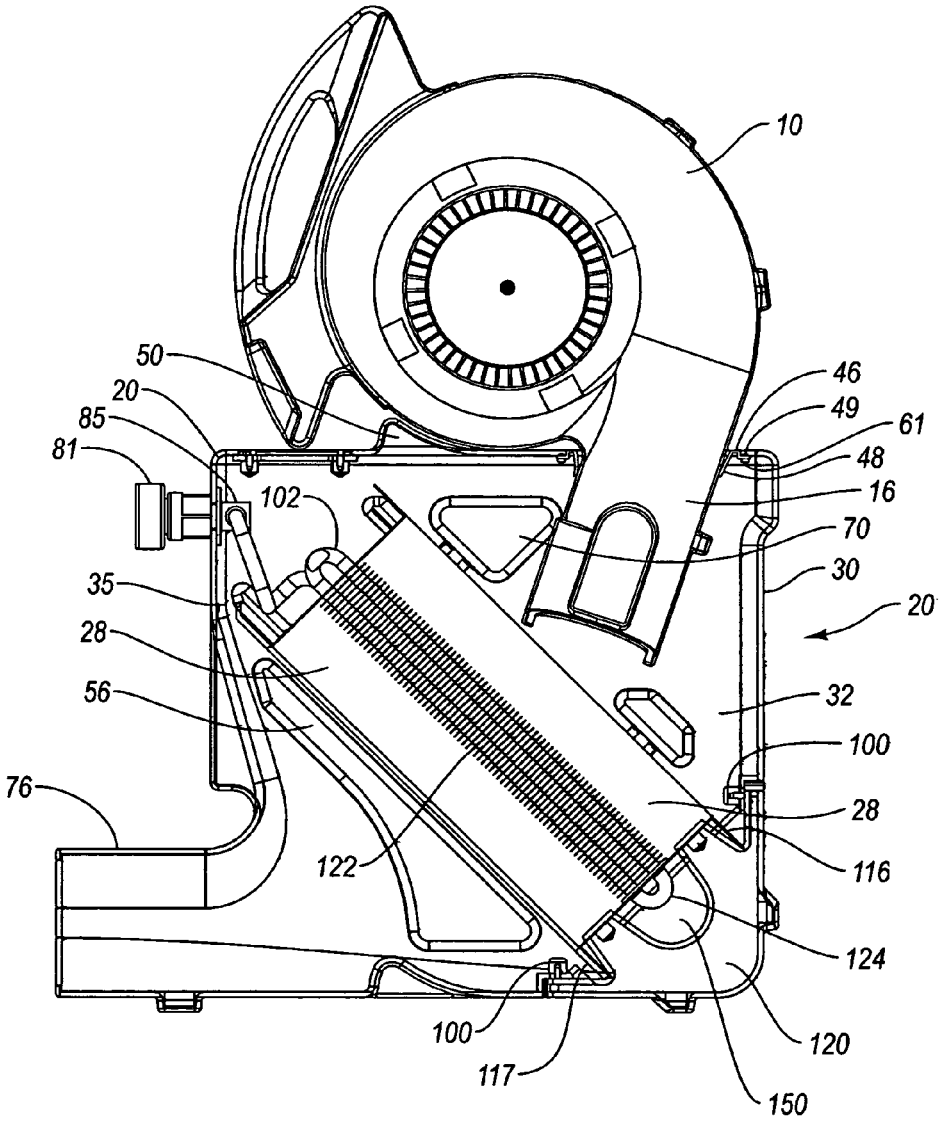
FIG. 3 is a cross-sectional side view of the heat exchanger assembly with removable centrifugal air mover as shown in FIG. 2.

As shown in FIGS. 2 and 3, the carpet drying system 8 comprises a heat exchanger assembly 20, centrifugal air mover 10 removably mounted thereon, and a boiler assembly 22 connected to heat exchanger assembly 20 via flexible hoses 24 and 26. In general, boiler assembly 22 heats and circulates a fluid, such as water, glycol, or other fluids, to and from a heat exchanger 28 located within heat exchanger assembly 20 via hoses 24 and 26. Centrifugal air mover 10 blows air into heat exchanger assembly 20. As the air from air mover 10 passes through heat exchanger assembly 20, the air passes by heat exchanger 28 and is heated by the hot circulating fluid. The heated air then exits heat exchanger assembly 20 where it is directed over, under, and/or about a wet carpet or other wetted surface to rapidly dry the surface.

The boiler assembly 22 comprises a boiler 23 in which the fluid is heated under pressure to a temperature that is typically greater than 65° C., more commonly greater than 80° C., and can be greater than 90° C. The boiler includes a heating element used for heating the fluid. The heating element is typically a gas burner although other heating elements, such as electric heating elements, can also be used. Boiler assembly 22 further comprises a pump 25 that is used to circulate the heated fluid into and out of boiler 23 through hoses 24 and 26. Although a number of different boilers can be used, in one embodiment boiler 23 has a BTU value in a range between about 200,000 to about 250,000. In one embodiment, pump 25 can produce a flow rate greater than about 1 cubic foot/minute (cfm) and more commonly greater than about 2 cfm, other values can also be used. One example of a boiler assembly 22 that can be used with the present invention is the 200,000 BTU boiler manufactured by Lochinvar out of Lebanon, Tenn. In alternative embodiments, boiler 23 can be replaced with other types of water heaters. In the embodiment depicted, boiler assembly 23 is mounted on a wheeled cart 27 so that boiler assembly 22 can be easily transported to different sites for use. In other embodiments, boiler assembly 22 can be mounted on a vehicle such as on the bed of a truck or in the back of a van.

Figure 4:
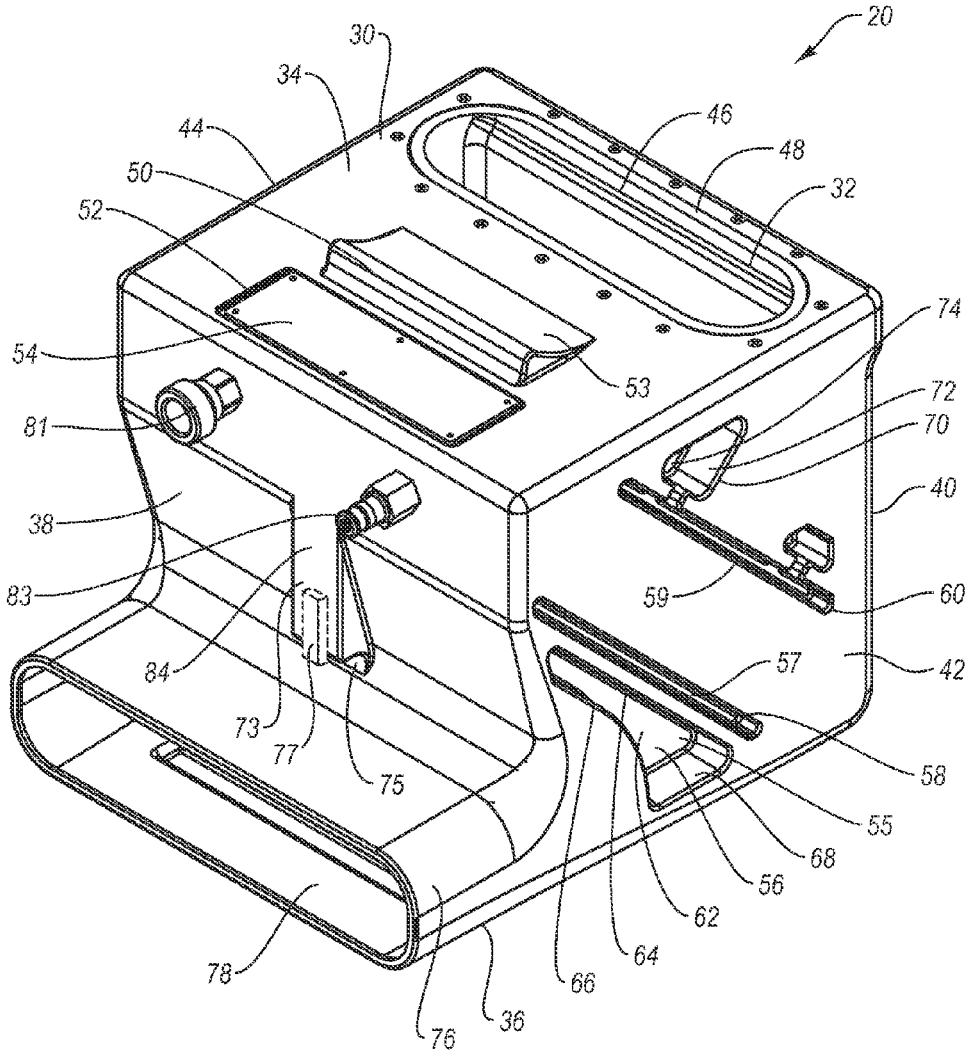
FIG. 4 is a perspective view of the heat exchanger assembly shown in FIG. 3.

As depicted in FIG. 4, heat exchanger assembly 20 comprises a housing 30 at least partially bounding a chamber 32 (FIG. 3). Housing 30 comprises a top surface 34, a bottom surface 36 spaced apart from top surface 34, a front face 38, and a back face 40 spaced apart from front face 38. Housing 30 further comprises two side surfaces 42 and 44 that are spaced apart from each other and extend between top surface 34 and bottom surface 36, and between front face 38 and back face 40. In the embodiment depicted, housing 30 has a substantially cubic configuration. In alternative embodiments, however, housing 30 can have a variety of different configurations.

Housing 30 is typically made of a polymeric material by blow molding. Of course, other molding processes, such as rotational molding, injection molding or die molding, can also be used. Likewise, other materials such as metal, fiberglass, composite or the like can also be used. Preferred materials are those that are not affected by water.

With continued reference to FIG. 4, an inlet port 46 is formed on housing 30 so as to communicate with chamber 32. It is through inlet port 46 that air is blown into heat exchanger assembly 20. In the depicted embodiment, inlet port 46 is formed on top surface 34. In other embodiments inlet port 46 can be formed on back face 40 (see, e.g. FIG. 9), front face 38 or on other surfaces. Although depicted as being substantially oval shaped, inlet port 46 can be rectangular or have other shapes.

As depicted in FIGS. 2 and 3, inlet port 46 is adapted to receive snout 16 of air mover 10. In one embodiment of the present invention, means are provided for effecting a seal between housing 30 and snout 16 when snout 16 is received within inlet port 46. By way of example and not by limitation, as depicted in FIGS. 3 and 4 a flexible seal 48 is mounted on housing 30 so as to at least substantially encircle inlet port 46. Seal 48 radially inwardly projects into inlet port 46 such that it biases against and forms a seal around snout 16 when the snout 16 is inserted into inlet port 46. Seal 48 can be mounted to housing 30 by gluing, molding, riveting, and/or using nuts 49 and bolts 51, as in the depicted embodiment, or any other fastening method which provides a secure and sealed connection.

When snout 16 of air mover 10 is inserted into inlet port 46, seal 48 bends inward into chamber 32, the surface of seal 48 forming a seal against snout 16 to help preventing air which air mover 10 blows into heat exchanger assembly 20 from exiting the heat exchanger assembly 20 through inlet port 46. Seal 48 is typically made of a soft flexible material that is resiliently elastic. Examples of materials include rubber, silicone, soft polymeric materials, and other materials having the desired properties. Back pressure from the air blown into housing 30 helps to seal seal 48 during operation by pushing seal 48 against snout 16. When the air mover 10 stops blowing air, the back pressure against the seal lessens, and snout 16 can be easily removed from inlet port 46.

Seal 48 is designed to allow various sizes of air movers to be used. Its simple design allows small and large snouts of different air movers to be inserted into inlet port 46 and to be at least substantially sealed using seal 48. Because the edges of seal 48 simply bend in and bias against snout 16, many sizes of snouts can be used. It is appreciated that the seal between seal 48 and snout 16 need not be perfect but sufficient so that a majority of the air passes through heat exchanger assembly 20. Nylon or other type bristles can also be positioned on the inside face of seal 48 to help resiliently bias seal 48 against snout 16.

In an alternative embodiment, seal 48 can simply a sheet of flexible material having an outside edge coupled with housing 30 and an inside edge that bounds an opening extending therethough, the opening being in alignment with inlet port 46. A resilient, elastic band is secured at the inside edge of the material so as to constrict the opening passing therethough. As snout 16 is received within inlet port 46, the elastic band is stretched around the snout 16 so as to seal there against. The flexible material and elastic band thus form a seal between housing 30 and snout 16. The flexible material can be a woven fabric, extruded polymeric sheet, or other material.

Returning to FIG. 4, a rest 50 projects from top surface 34. Rest 50 is shaped such that it at least partially supports air mover 10 when snout 16 is received within inlet port 46 of heat exchanger assembly 20. In the depicted embodiment, rest 50 has a curved top face 53 configured to complementary match the curve of air mover 10. It is appreciated, however, rest 50 can have other alternatively shapes, so long as rest 50 is able to support air mover 10. Rest 50 functions to both help stabilize air mover 10 and, as will be discussed below in greater detail, to help orient air mover 10 relative to heat exchanger 28 (FIG. 3).

Figure 5:
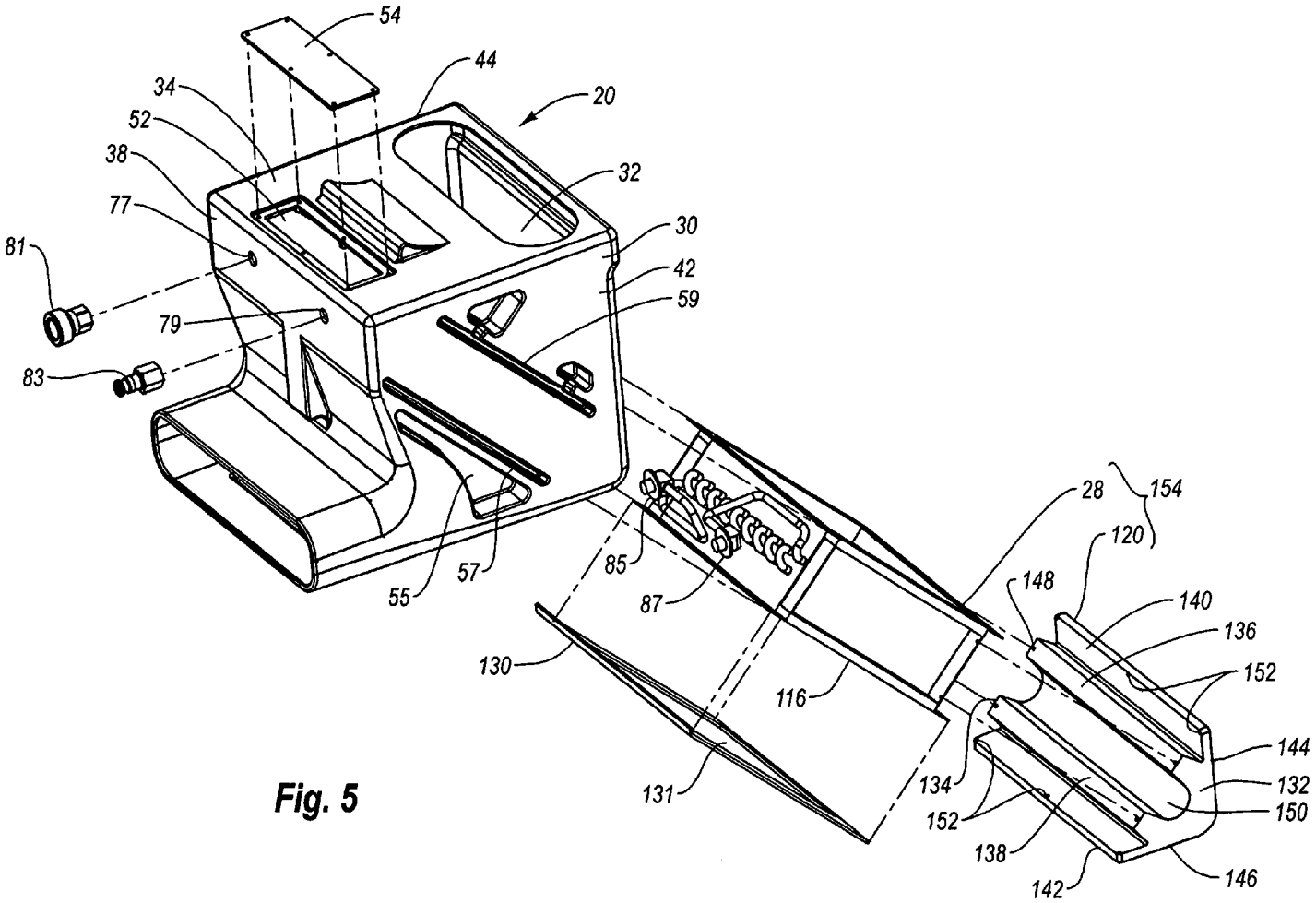
FIG. 5 is an exploded front perspective view of the heat exchanger assembly shown in FIG. 4.

Turning to FIG. 5, an access port 52 is formed on housing 30 so as to communicate with chamber 32. Access port 52 is sized so that access can be gained to heat exchanger 28 once heat exchanger 28 is installed within housing 30, as described below. In one embodiment, access port 52 is formed on top surface 34 adjacent to front face 38. In alternative embodiments, access port 52 can be formed on front face 38 or other surfaces. An access panel 54 is placed over access port 52 and is removably attached to top surface 34 by screws or other method so that it completely covers access port 52. A gasket may also be used between access panel 54 and access port 52 to better seal chamber 32 against air leaking out through access port 52.

Figure 6:
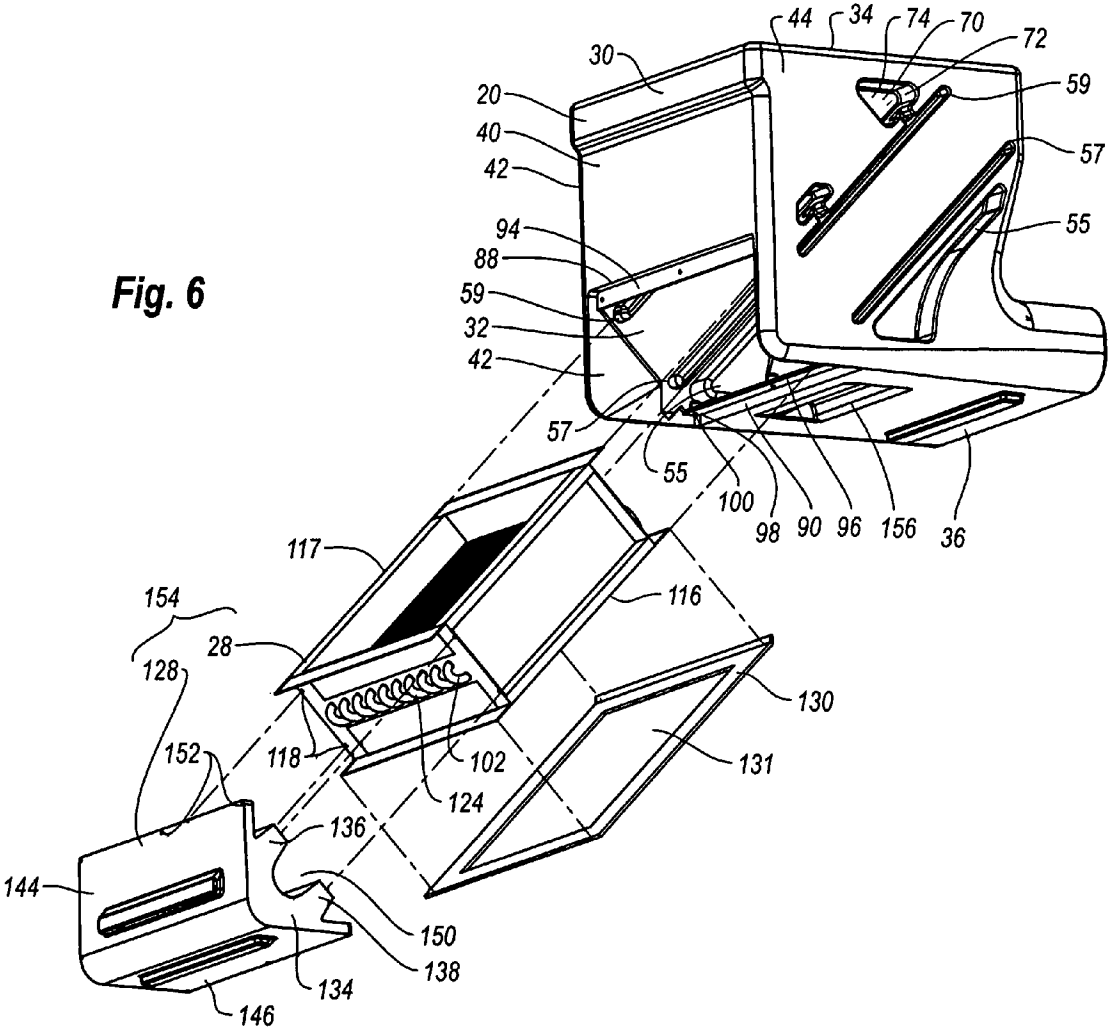
FIG. 6 is an exploded back perspective view of the heat exchanger assembly shown in FIG. 4.

As depicted in FIGS. 5 and 6, an elongated support 55 projects from each side surface 42 and 44 into chamber 32. Similarly, a pair of elongated alignment ribs 57 and 59 also project from each side surface 42 and 44 into chamber 32. It is appreciated that support 55 and alignment ribs 57 and 59 are identical for each side surface 42 and 44 and thus only those on side surface 42 will be discussed.

As depicted in FIG. 4, support 55 includes an inner wall 62, a top wall 64, a side wall 66, and a bottom wall 68 that bound a channel 56. The top, side and bottom walls 64, 66, 68 each extend into chamber 32 between side surface 42 and inner wall 62 along the longitudinal length of support 55. Support 55 generally runs diagonally across side surface 42 from a point near bottom surface 36 of housing 30 to a point near front face 38 in such a way that support 55 is nearer back face 40 at the point where support 55 is nearest bottom surface 36.

Alignment ribs 57 and 59 also project into chamber 32 from side surface 42 and run substantially parallel to each other and to support 55. However, alignment ribs 57 and 59 do not project into chamber 32 as far as does support 55. In the depicted embodiment, alignment ribs 57 and 59 bound channels 58 and 60, respectively, that are recessed on the exterior of side surface 42 and 44. As will be discussed below in greater detail, support 55 acts as a resting surface for heat exchanger 28 while alignment ribs 57 and 59 help stabilize and ensure proper alignment and positioning of heat exchanger 28. The formation of support 55, ribs 57 and 59, and channels 56, 58, and 60 also provide structural stability for housing 30 and help eliminate warping during molding. In alternative embodiments, however, support 55 and ribs 57 and 59 can be solid and/or separately connected to housing 30, thereby eliminating channels 56, 58, and 60.

In some embodiments, hand holds are located on side surfaces 42 and 44 to allow for easier movement and transport of heat exchanger assembly 20. In the depicted embodiment, recesses 70 formed on side surfaces 42 and 44 are provided as hand holds. Each recess 70 comprises a sidewall 72 which extends into chamber 32 between the side surface 42 or 44 and an inner wall 74. Recess 70 is depicted as being substantially triangular but other configurations can alternatively be used. Recess 70 can be any shape and size which provides a user with the ability to grasp and lift heat exchanger assembly 20. In other embodiments, hand holds can be appendages coming out of heat exchanger assembly 20, such as bars, pegs, or handles which are attached to side surfaces 42 and 44 or other areas of housing 30.

An exchanger snout 76 projects from housing 30 of heat exchanger assembly 20. Snout 76 at least partially bounds an outlet port 78 which communicates with chamber 32. It is through exchanger snout 76 that heated air exits heat exchanger assembly 20. In one embodiment, exchanger snout 76 is elongated having a substantially flat top and bottom surface and rounded sides and is located on the bottom portion of front face 38 so as to be easily inserted under a carpet during use. As can be appreciated, other shapes and locations for snout 76 can also be used. For example, snout 76 can be a rectangular shape with the sides being squared off. Also, snout 76 can be located on another portion of front face 38 or another surface of housing 30. Snout 76 can be attached to or integrally molded with housing 30. Exchanger snout 76 is typically integrally molded onto housing 30 and is made of the same material as housing 30, although this is not required.

Projecting from front face 38 is a protrusion 84. Protrusion 84 has a flat face 73 that extends above a recess 75. Flat face 73 is configured to receive a carpet clamp, as represented by dashed box 77, if so desired. The carpet clamp is used to hold the carpet in place above snout 76 so that air can be blown underneath the carpet. The carpet clamp generally comprises a clamping mechanism and a lever. The clamping mechanism becomes biased against the carpet when the lever is activated, thus holding the carpet in place relative to heat exchanger assembly 20. The clamping mechanism is released from biasing against the carpet when the lever is released. Attachment of the carpet clamp can be accomplished by screws, glue or other attachment method known in the art. There are many types of carpet clamps known in the art which can be used with the present invention. It is appreciated that one of skill in the art would be able to adapt and use any of these carpet clamps.

Turning now to FIG. 6, back face 40 of housing 30 extends between side surfaces 42 and 44, and from top surface 34 down towards bottom surface 36. However, back face 40 only extends part way to bottom surface 36, terminating at a bottom edge 88 before reaching the bottom surface 36. Bottom surface 36 extends between side surfaces 42 and 44 and from exchanger snout 76 back towards back face 40. However, bottom surface 36 only extends part way to back face 40, terminating at a back edge 90 before reaching the back surface. Thus an opening 92 in housing 30 of heat exchanger assembly 20 is formed which communicates with chamber 32. Opening 92, bounded by the bottom edge 88 of back face 40, the back edge 90 of bottom surface 36, and side surfaces 42 and 44, provides access for heat exchanger 28. Flanges 94 and 96 extend into opening 92 from edges 88 and 90, respectively. One or more apertures 98 are formed in flanges 94 and 96 with a threaded nut 100 corresponding to each aperture 98 being secured on the chamber side of flanges 94 and 96.

Figure 7:
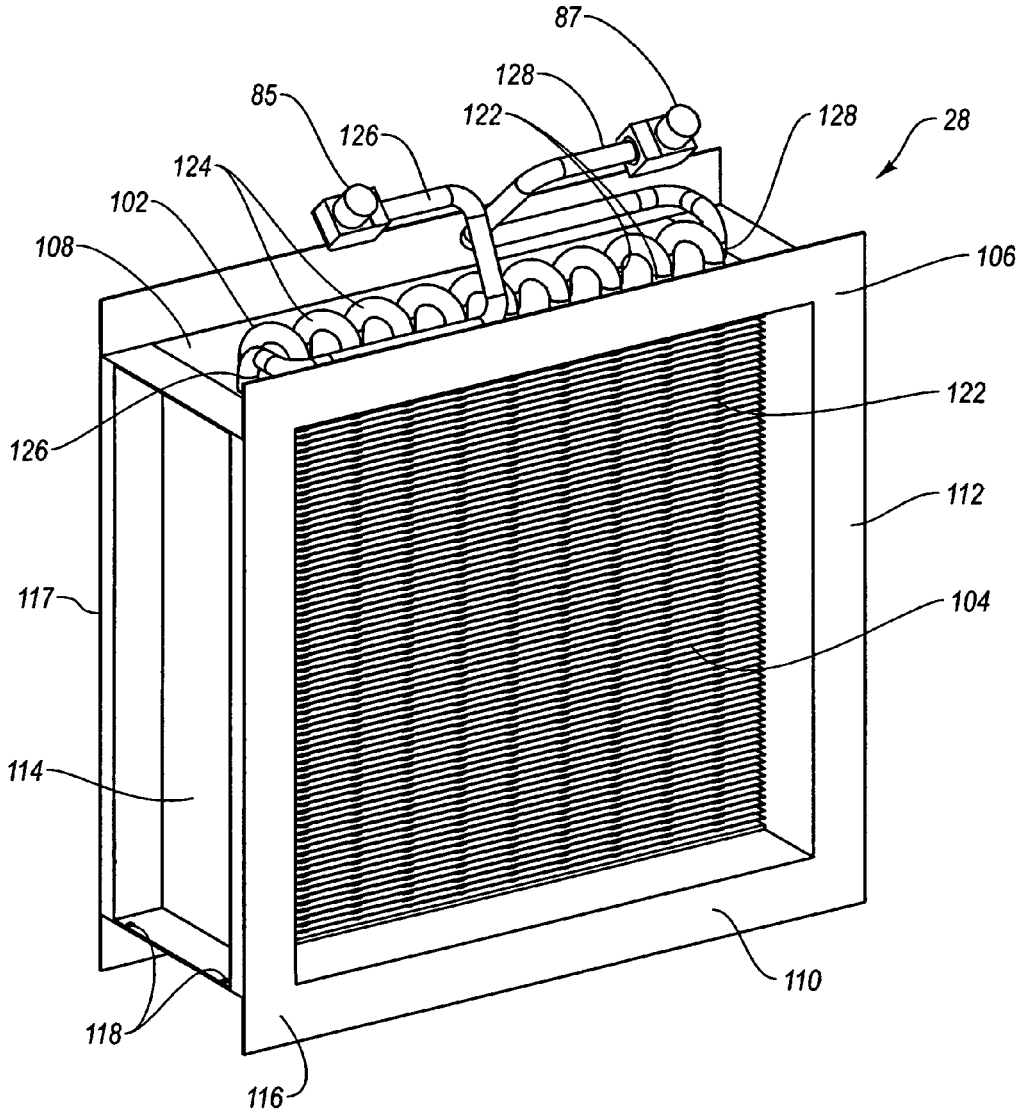
FIG. 7 is a perspective view of the heat exchanger assembly shown in FIG. 5.

Turning to FIG. 7 in conjunction with FIG. 6, heat exchanger 28 comprises a housing 106, a tube assembly 102 partially disposed within housing 106 and a plurality of fins 104 projecting away from tube assembly 102. Housing 106 comprises a top support 108 and a spaced apart bottom support 110. Two spaced apart side supports 112 and 114 extend between top and bottom supports 108 and 110 at opposing ends thereof. Supports 108, 110, 112, 114 all extend between a front face 116 and a rear face 117. In the depicted embodiment, top support 108 and bottom support 110 are substantially parallel to each other and are horizontally disposed. Side supports 112 and 114 are substantially parallel to each other and substantially perpendicular to top support 108 and bottom support 110, thus forming a housing 106 which is substantially square or rectangular shaped when viewed from front face 116. Other geometries may alternatively be used for housing 106 in other embodiments. Housing 106 is typically comprised of rigid metal, but other materials alternatively can be used. One or more apertures 118 are formed on bottom support 110 to provide a means for heat exchanger 28 to be secured to corner piece 120, as described below.

Tube assembly 102 comprises a plurality of straight tubes 122 (see also FIG. 3) which extend between top support 108 and bottom support 110 of heat exchanger 28, the tubes 122 being substantially vertically oriented and substantially parallel to each other. On both ends of each straight tube 122, a u-shaped connecting tube 124 connects the end of the straight tube 122 to a different adjacent straight tube 122 in such a manner that all the connected tubes 122 and 124 form a single pathway of coiled tubing for a pressurized heated liquid to pass therethrough. The connection can be performed by welding or soldering or any other method which will allow a water-tight seal under pressure. Tubes 122 and 124 are typically comprised of metal, such as copper, but other materials can also be used. It is also appreciated that a continuous section of extruded tubing, such as a polymeric tubing, can also be used. Thus, tube assembly 102 is only one example to tubing that can be used with the present invention.

Tube assembly 102 has an inlet end 126 and an opposing outlet end outlet end 128. Inlet end 126 is coupled with a connector 85 while outlet end 128 is coupled with a connector 87. In one embodiment inlet end 126 and outlet end 128 of tube assembly 102 can be formed from flexible tubing to help facilitate proper placement of connectors 85 and 87. Heated fluid can thus enter inlet end 126 through connector 85, travel through tube assembly 102, and then exit through connector 87 at outlet end 128. Although tube assembly 102 is shown being generally coiled, it is appreciated that tube assembly 102 can be laid out in a variety of different paths.

A plurality of fins 104 extend away from each tube 122 along the length thereof. Fins 104 are close together, but spaced apart so that air can freely flow between them. Fins 104 are made of a heat conductive material, such as metal.

Returning to FIGS. 5 and 6, a gasket 130 may be used to provide a better seal between heat exchanger 28 and housing 30. In the depicted embodiment, gasket 130 is substantially square to match the shape of the front face 116 of heat exchanger 28. Gasket 130 may be the same size or slightly larger or smaller than front face 116. An opening 131 is defined in gasket 130, the opening matching the size and shape of the area through which air passes tube assembly 102 so that when gasket 130 is attached to heat exchanger 28 during assembly, air can still pass through tube assembly 102. Gasket 130 can be made of rubber or other sealing material.

Heat exchanger assembly 20 further comprises a corner piece 120 that is used to secure the heat exchanger 28 in place and close off opening 92. Corner piece 120 is typically made of the same material as housing 30 of heat exchanger assembly 20, although this is not required. Corner piece 120 comprises two spaced apart side walls 132 and 134 with two crossbeams 136 and 138 and two flanges 140 and 142 extending therebetween. Corner piece 120 also comprises a back surface 144 and bottom surface 146 which also extend between the two side walls 132 and 134. Crossbeams 136 and 138 are substantially parallel to each other and extend between side walls 132 and 134. One or more screw holes 148 may be formed on one or both crossbeams 136 and/or 138, corresponding to apertures 118 formed in bottom support 110 of heat exchanger 28. A cavity 150 is formed within corner piece 120 between crossbeams 136 and 138 which also extends between side walls 132 and 134. Cavity 150 is deep enough so that when corner piece 120 is fastened to bottom support 110 of heat exchanger 28, there is enough space for connecting tubes 124, which project out from the bottom support, to fit within cavity 150. Flanges 140 and 142 also extend between side walls 132 and 134. Flange 140 extends up from back surface 144 and is substantially in the same plane as back surface 144. Flange 142 extends forward from bottom surface 146 and is in the same plane as bottom surface 146. One or more apertures 152 are formed on the edges of flanges 140 and 142.

During use, heat exchanger 28 is mounted within chamber 32 of heat exchanger assembly 20 as shown in FIG. 3. As best depicted in FIGS. 5 and 6, assembly of heat exchanger assembly 20 takes place in a number of steps.

For those embodiments in which a gasket is used, gasket 130 is attached to front surface 116 of heat exchanger 28. Gasket 130 is placed on heat exchanger 28 such that the gasket opening 131 is aligned with the area through which air passes through tube assembly 102 so as not to constrict air flow through heat exchanger 28 when in operation. Gasket 130 can be attached in any desired method, including, but not limited to, gluing, etc.

Next, corner piece 120 is attached to heat exchanger 28 to produce an exchanger/corner assembly 154. Corner piece 120 is placed next to heat exchanger 28 such that crossbeams 136 and 138 of corner piece 120 abut bottom support 110 of heat exchanger 28 and apertures 118 line up with screw holes 148. The curved tubes 124 of tube assembly 102 protrude into cavity 150 formed in corner piece 120 but do not touch any portion of the corner piece, as shown in FIG. 3. Corner piece 120 is securely attached to heat exchanger 28 by passing a screw with a head larger than aperture 118 through each aperture 118 on bottom support 110 of heat exchanger 20, then screwing the screws into screw holes 148 of corner piece 120 until secure. Other means of attachment can alternatively be used, such as gluing, soldering, or any other means of secure attachment.

The exchanger/corner assembly 154 is then slid into chamber 32 of heat exchanger assembly 20 via opening 92 until the exchanger/corner assembly 154 is fully inserted in the position shown in FIG. 3. When fully inserted, air that enters heat exchanger assembly 20 through inlet port 46 must pass through heat exchanger 28 before exiting heat exchanger assembly 20 through snout 76. When fully inserted, front face 116 of heat exchanger 28 rests on top wall 64 of supports 55 of housing 30, with gasket 130 being disposed between front face 116 and supports 55 to prevent air from leaking around the outside of heat exchanger 28. Side support 112 and 114 are is disposed against alignment ribs 57 and 59 of side surfaces 42 and 44 of housing 30, such that the fit is snug, but not binding. Corner piece 120 covers opening 92 such that apertures 152 formed on flanges 140 and 142 are aligned with apertures 98 on flanges 94 and 96, respectively.

Once exchanger/corner assembly 154 has been securely inserted into heat exchanger assembly 20, connectors 85 and 87 should protrude through apertures 77 and 79, respectively, on front face 38 of housing 30. Connectors 85 and 87 can manually be adjusted through access port 52 to allow the connectors to protrude through apertures 77 and 79, if needed. Once connectors 85 and 87 are in place, fittings 81 and 83 are securely connected to connectors 85 and 87, respectively, and access panel 54 is secured in place over access port 52 by screwing in the screws which secure the access panel to top surface 34. Fittings 81 and 83 are configured for removably coupling houses 24 and 26 to tube assembly 102. In one embodiment, fitting 81 and 83 can comprise quick release hose couplings. Other types of fitting, such as threaded fittings can also be used. The above discussed fittings and other structures that will perform the same function are examples of means for removably connecting the first end and the second end of tube assembly 102 of heat exchanger 28 to hoses 24 and 26 or other conduits for delivering heated fluid to and from tube assembly 102.

Once fully inserted as described above, exchanger/corner assembly 154 is securely attached to heat exchanger assembly 20 by passing a threaded bolt with a head larger than aperture 152 through each aperture 152 on corner piece 120 and aperture 98 on flanges 94, 96 and threading the bolt into threaded nut 100 until tight. Other fastening methods can alternatively be used. A gasket may also be used where corner piece 120 biases against housing 30 to provide a better seal.

In the fully assembled configuration depicted in FIG. 3, it is noted that snout 16 of air mover 10 and heat exchanger 28 are orientated so that the air exiting snout 16 passes through tube assembly 102 at an oblique angle. This orientation optimizes the time that the air is exposed to heat exchanger 20, thereby helping to increase the temperature of the air passing out through exchanger snout 76. In alternative embodiments, however, snout 16 can be perpendicular to heat exchanger 20 (see FIG. 9). To further assist in the heat transfer, it is also appreciated that multiple rows of tubing can be formed so that the air has to pass by each row of tubing.

In some embodiments, heat exchanger assembly 20 is designed to be easily stackable. For example, as shown in FIG. 6, heat exchanger assembly 20 has a cavity 156 formed on bottom surface 36 that is shaped to allow blower rest 50 to be inserted into it when the bottom surface 36 of one heat exchanger assembly 20 is seated on the top surface 34 of another heat exchanger assembly 20. In this way, a second heat exchanger assembly can be placed on top of heat exchanger assembly 20 for storage, and the stacked assemblies will be stable and easily stored.

Returning to FIGS. 2 and 3, one method of use is now described. Heat exchanger assembly 20, as assembled and described above, is positioned next to a wet carpet or other wet surface, perhaps by using hand holds 70. If desired, exchanger snout 76 is positioned under the edge of the carpet for floating the carpet. As with conventional procedures, the wetted carpet pad can first be removed. Alternatively, however, because the speed at which the present system can dry, the wetted carpet paid can also be retained with exchanger snout 76 being positioned above or below the carpet pad. If desired, a carpet clamp mounted on heat exchanger 20 can be used to releasably secure the carpet in place relative to heat exchanger assembly 20. Snout 16 of air mover 10 is removably received within inlet port 46 of heat exchanger assembly 20, seal 48 forming a seal around snout 16 as snout 16 is inserted into the inlet port 46. In this position, air mover 10 sits on rest 50 to provide a stable platform. The snout 16 forms an angle with heat exchanger 28 to allow for a more efficient airflow through the heat exchanger 28.

A heating source, such as the boiler assembly 22 shown in FIG. 2, is connected to heat exchanger assembly 20 by attaching flexible hoses 24 and 26 to inlet fitting 81 and outlet fitting 83, respectively. By using flexible hoses, it is easy to manipulate the hoses through a building and around corners. If desired, an insulation layer can be disposed around hoses 24 and 26. In alternative embodiments rigid piping or other forms of conduits can also be used to replace flexible hoses. Boiler assembly 22 is then activated, causing hot, pressurized fluid to circulate through heat exchanger 28 at a select temperature. The heated fluid travels through tube assembly 102 of heat exchanger 28 which transfers the heat out through fins 104. This transfer of heat causes the fluid to start cooling. The cooling liquid then exits pipe assembly 102 through outlet fitting 81 and the fluid is transferred by hose 26 back to the boiler assembly 22. The fluid is then reheated by the boiler and passed back through heat exchanger 28 to repeat the process.

Next, air mover 10 is activated which forces air into chamber 32 through snout 16 at a rate generally in a range between about of 2,000-4,000 cfm or more. Seal 48 of inlet port 46 prevents the air from escaping back out of heat exchanger assembly 20 through inlet port 46. The force of the air entering chamber 32 forces the air to then pass through heat exchanger 28, being heated as it passes through the fins 104 of the heat exchanger. Because of the high BTUs produced by the boiler, the fast-moving air is adequately heated. The heated air exits heat exchanger assembly 20 through outlet port 78 of exchanger snout 76. If exchanger snout 76 has been placed under the edge of a carpet, the heated air exiting heat exchanger 20 is blown below the carpet and/or about other surfaces for drying. As a result of the air now being heated, the carpet, subfloor, and related structures are dried substantially quicker than if only using a conventional air mover 10 by itself.

It is appreciated that heat exchanger assembly 20 can be used in a variety of different ways. For example, a variety of different adapters, ducts, vents, hoses, or other extensions can be coupled with exchanger snout 76 so that the heated air can be more precisely directed to desired locations such as along or within a wall or cupboard. Furthermore, where a hardwood floor and/or walls have been soaked, a flexible barrier can be placed over the floor and partially secured around the edges of the floor. By placing the exchanger snout 76 under an edge of the barrier and blowing air therethrough, the heated air covers the floor drying the floor. The barrier also directs the air to the surrounding walls to facilitate drying of the walls. This is substantially the same action that occurs when floating a carpet.

The above described heat exchanger assembly 20 is only one embodiment of the present invention to which a number of modifications can be made. For example, in contrast to having snout 16 of air mover 10 removably received directly into inlet port 46 of heat exchanger assembly 20, it is appreciated that ducting, seals, tubing or other forms of connections can be used to couple snout 16 to inlet port 46. Where such ducting is used, it is appreciated that centrifugal air mover 10 can be replaced with other types of air mover such as an axial air mover or other types of fans or pumps.

Figure 8:
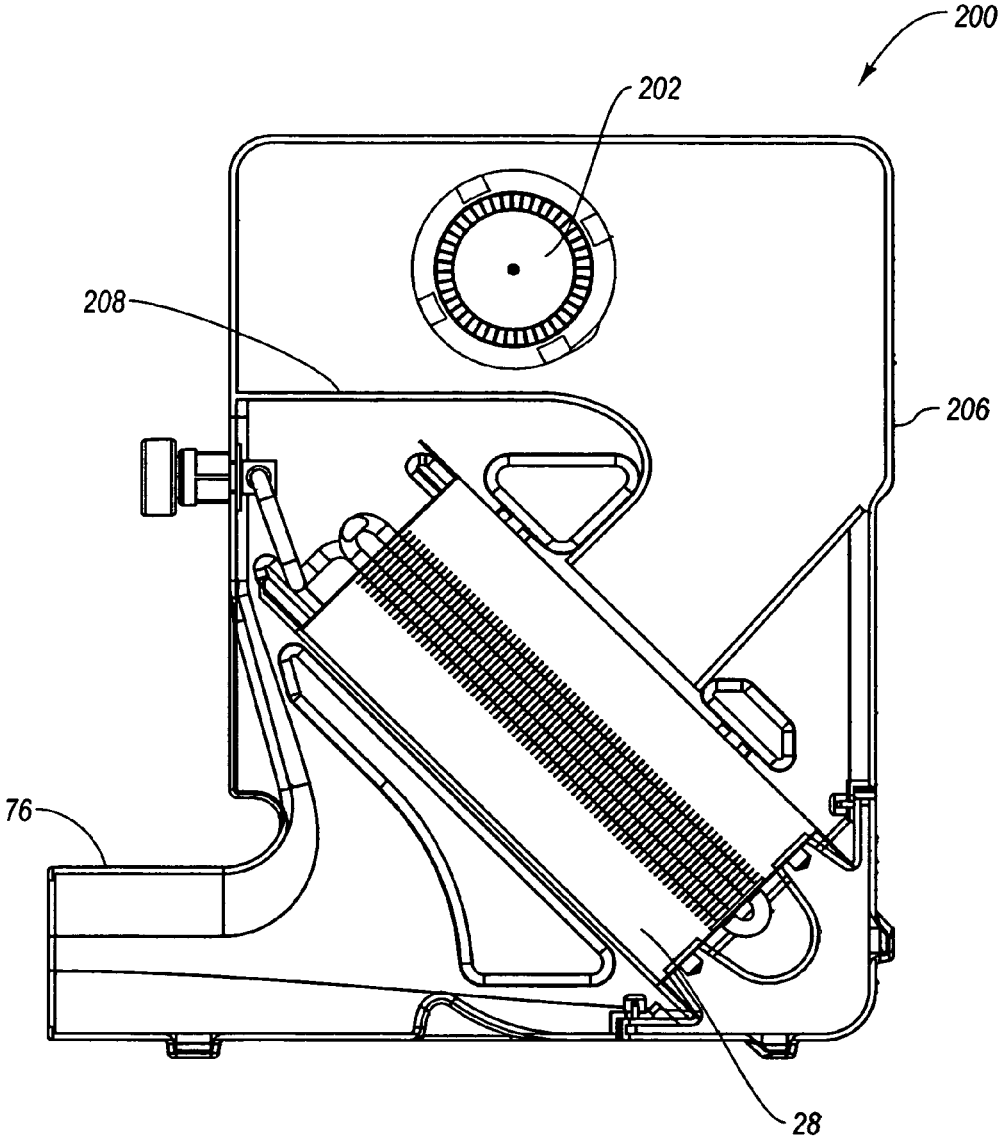
FIG. 8 is a cross-sectional side view of an alternative embodiment of a heat exchanger assembly with a centrifugal fan housed therein.

Furthermore, depicted in FIG. 8 is an alternative embodiment of a heat exchanger assembly 200 wherein like elements between heat exchanger assemblies 20 and 200 are identified by like reference characters. Heat exchanger assemblies 20 and 200 are substantially similar except that as opposed to air mover 10 being removably attached to heat exchanger assembly 20, a centrifugal fan 202 is incorporated directly into a housing 206 of heat exchanger assembly 200. Blower fan 202 draws air from outside of housing 203 and forces it through heat exchanger 28 and out exchanger snout 76. A guard 208 is disposed within housing 203 and is configured to direct the air from fan 202 to heat exchanger 28. In contrast to fan 202 being positioned to blow the air past heat exchanger 28, it is appreciated that fan 202 can be also be positioned so as to suck air past heat exchanger 28 before being expelled through exchanger snout 76. Air mover 10 and centrifugal fan 202 are examples of means for blowing air by heat exchanger 28 so that the air exits through exchanger snout 76. Other types of fans, blowers, pumps, compressors, axial air movers, or the like can also be used and are alternative means.

Figure 9:
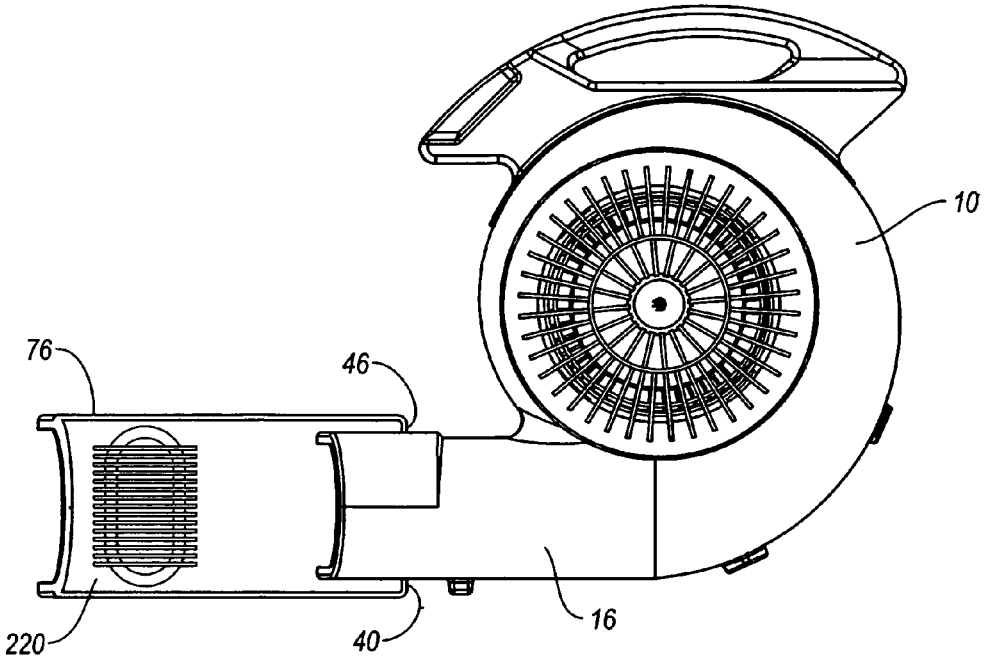
FIG. 9 is an elevated side view of an other alternative embodiment of a heat exchanger assembly.
Figure 10:
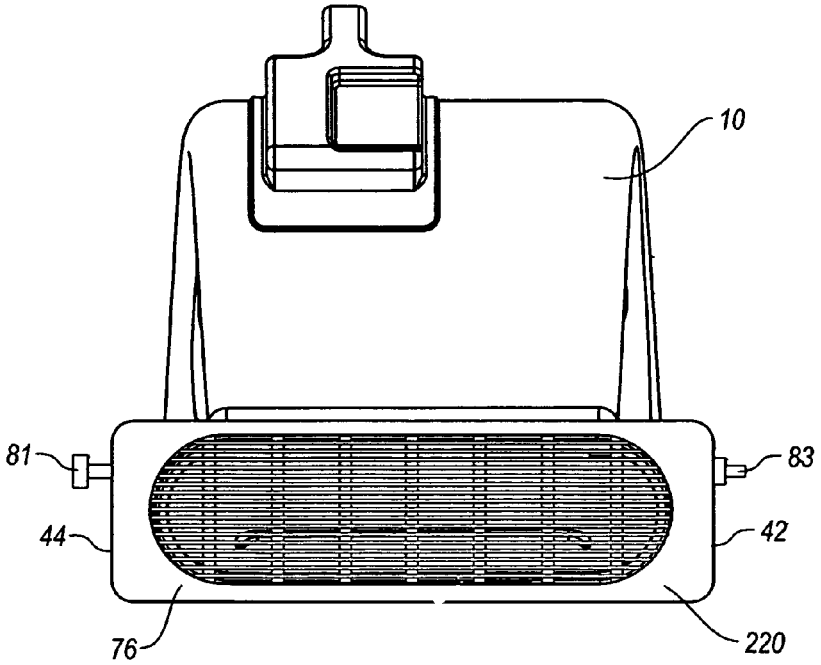
FIG. 10 is a front view of the heat exchanger assembly shown in FIG. 9.

Depicted in FIGS. 9 and 10 is another alternative embodiment of a heat exchanger assembly 220 wherein like elements between heat exchanger assemblies 20 and 220 are identified by like reference characters. Heat exchanger assembly 220 is shown smaller in size than heat exchanger assembly 20. In one embodiment, the height and width of heat exchanger assembly 220 are only slightly taller and wider, respectively, than the height and width of snout 16.

In contrast to inlet port 46 being formed on top surface 34 of heat exchanger assembly 20, inlet port 46 is formed on back surface 40 of heat exchanger assembly 220, such that when snout 16 of air mover 10 is inserted into inlet port 46, exchanger snout 76 of heat exchanger assembly 220 is substantially in line with snout 16. Because of the smaller size of heat exchanger assembly 220, inlet fitting 81 and outlet fitting 83 are placed on side surfaces 42 and/or 44 to more easily allow exchanger snout 76 to be placed underneath a wet carpet. Inlet fitting 81 and outlet fitting 83 can be placed on opposite side surfaces, as shown in the depicted embodiment, or the fittings can both be placed on the same side surface. Being sized slightly larger than snout 16 and having snout 76 being in-line with snout 16 allows air mover 10, when attached to heat exchanger assembly 220, to be placed on the floor as it would when not using the present invention, providing for easier use and placement.

In view of the foregoing, it is appreciated that various embodiments of the present invention have a number of unique benefits. For example, select embodiments provide for heating of a large volume of air which can be blown below a carpet and which can be used with conventional air movers that are ubiquitous in the water restoration services. Because of the heating capabilities, the inventive systems can be efficiently used for drying in cold and/or humid environments. Likewise, because of the rapid drying capabilities, embodiments of the present invention can be used to dry wetted carpet, carpet pad, and other structures while remaining in place, thereby saving resources and minimizing service time.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes which come within the meaning and range of equivalency of the claims are to be embraced within their scope.

What is claimed is:

1. A portable carpet drying system comprising:

a portable centrifugal air mover comprising a body having a snout projecting therefrom, the air mover being adapted to blow air out through the snout; and a portable heat exchanger assembly comprising:

a housing at least partially bounding a chamber, the housing having an inlet port and an outlet port that each communicate with the chamber;

a seal mounted on the housing, the seal having an inside edge that bounds an opening that is in alignment with the inlet port, the air mover being seated on the housing with the snout extending through the inlet port and into the chamber of the housing, the snout forcing the seal to bend into the chamber and bias against the snout so that when air is passed from the air mover into the chamber air pressure created within the chamber pushes the seal against the snout; and a heat exchanger at least partially disposed within the chamber of the housing such that air blown from the air mover is passed by the heat exchanger and out through the outlet port, wherein the housing further comprises a top surface and an opposing bottom surface, a front face and an opposing back face that extend between the top and bottom surfaces, and a pair of opposing side faces that extend between the top and bottom surfaces, the inlet port being formed on the top surface of the housing and an exchanger snout projecting from the front face of the housing and bounding the outlet port, the air mover being seated on the top surface of the housing with the snout extending through the inlet port so that the air exiting the snout passes through the heat exchanger at an oblique angle.

2. The portable carpet drying system of claim 1, wherein the air mover is electrically operated and is a separate and discrete unit from the heat exchanger assembly.

3. The portable carpet drying system of claim 1, wherein the heat exchanger comprises:

tubing with a first end and an opposing second end, the tubing being adapted to allow a heated liquid to travel therethrough; and fins outwardly projecting from the tubing, the fins being spaced apart such that air can freely flow between the fins.

4. The portable carpet drying system of claim 1, further comprising a boiler, a first hose extending from the boiler to the heat exchanger for delivering heated fluid to the heat exchanger, and a second hose extending from the heat exchanger to the boiler for delivering fluid from the heat exchanger to the boiler.

5. The portable carpet drying system of claim 1, wherein the housing has a substantially box shaped configuration.

6. The portable carpet drying system of claim 1, further comprising a rest projecting from the top surface of the housing, the rest directly supporting the body of the air mover.

7. The portable carpet drying system recited in claim 6, wherein the portable heat exchanger assembly comprises a first portable heat exchanger assembly and wherein the bottom surface includes a recess configured to receive a corresponding rest of a second portable heat exchanger when the first portable heat exchanger assembly is stacked on top of the second portable heat exchanger assembly.

8. The portable carpet drying system of claim 1, wherein the snout of the air mover is removably disposed within the inlet port of the housing.

9. The portable carpet drying system of claim 1, wherein the seal further comprises an outside edge that is secured to the housing.

10. The portable carpet drying system of claim 1, wherein the inside edge of the seal resiliently biases against the snout of the air mover at a spaced apart location from the housing.

11. The portable carpet drying system of claim 1, wherein at least a portion of the snout of the air mover is freely disposed within the chamber of the housing.

12. The portable carpet drying system of claim 1, further comprising a carpet clamp mounted on the housing of the heat exchanger assembly.

13. The portable carpet drying system of claim 1, further comprising handle projecting from the body of the air mover, an opening extending through the handle.

14. The portable carpet drying system of claim 1, wherein the inlet port is substantially oval.

15. The portable carpet drying system of claim 1, wherein the exchanger snout projects from the housing such that the air exits the exchanger snout during a use of the portable carpet drying system and wherein the exchanger snout is positioned under a carpet during the use.

16. The portable carpet drying system of claim 1, further comprising at least one handle formed on the housing of the portable heat exchange assembly, the at least one handle being configured to enable a user to lift and carry the portable heat exchanger assembly.

17. The portable carpet drying system of claim 1, further comprising a handle formed on each of the opposing side faces of the housing of the portable heat exchanger assembly.

18. The portable carpet drying system of claim 1, wherein the air opening of the centrifugal air mover is openly exposed to the surrounding environment.

19. The portable carpet drying system of claim 1, wherein the heat exchanger is secured to the housing and produces heat that radiates therefrom.

20. A portable carpet drying system comprising:

a portable heat exchanger assembly comprising:

a housing at least partially bounding a chamber, the housing having an inlet port and an outlet port that each communicate with the chamber, the housing further comprising a top surface and an opposing bottom surface, a front face and an opposing back face that extend between the top and bottom surfaces, and a pair of opposing side faces that extend between the top and bottom surfaces, an exchanger snout projecting from the front face of the housing and bounding the outlet port;

a rest outwardly projecting from the housing and having a support surface that is sloped relative to the bottom surface of the housing;

a seal mounted on the housing, the seal having an inside edge that bounds an opening that is in alignment with the inlet port; and a heat exchanger at least partially disposed within the chamber of the housing such that air blown from inlet port to the outlet port is passed by the heat exchanger; and a portable centrifugal air mover comprising a body, an air inlet, and a snout projecting from the body, the air mover being adapted to draw air in through the air inlet and blow the air out through the snout, the body resting on the sloped support surface of the rest so that the air inlet is openly exposed outside of the chamber of the housing and so that the snout extends through the inlet port and into the chamber of the housing at an oblique angle relative to the bottom surface of the housing, at least a portion of the snout being freely disposed within the chamber of the housing, the snout forcing the seal to bend into the chamber and bias against the snout so that when air is passed from the air mover into the chamber air pressure created within the chamber pushes the seal against the snout.

21. The portable carpet drying system of claim 20, wherein the air mover is freely resting on the rest.

22. The portable carpet drying system of claim 20, wherein the air mover can be freely removed from housing during operation of the air mover.

23. The portable carpet drying system of claim 20, wherein the housing has a substantially box shaped configuration and the inlet port is formed on the top surface of the housing.

24. The portable carpet drying system of claim 20, wherein the rest has a curved surface which supports the body of the air mover.

25. The portable carpet drying system of claim 20, further comprising a carpet clamp mounted on the housing of the heat exchanger assembly.

26. The portable carpet drying system of claim 25, further comprising a protrusion projecting from the front face of the housing, the protrusion having a flat face portion, wherein the carpet clamp is mounted to the flat face portion of the protrusion.

27. The portable carpet drying system of claim 20, further comprising handle projecting from the body of the air mover.

28. The portable carpet drying system of claim 20, further comprising at least one handle formed on the housing of the portable heat exchanger assembly, the at least one handle being configured to enable a user to lift and carry the portable heat exchanger assembly.

29. The portable carpet drying system of claim 20, wherein the snout projects into the chamber of the housing at an oblique angle relative to the heat exchanger.

30. The portable carpet drying system of claim 20, wherein the air exiting the snout passes through the heat exchanger at an oblique angle.

31. A portable carpet drying system comprising:

a carpet;

a portable heat exchanger assembly comprising:

a housing at least partially bounding a chamber, the housing having an inlet port and an outwardly projecting exchanger snout, the exchanger snout bounding an outlet port that communicate with the chamber, the housing further comprising a top surface and an opposing bottom surface, a front face and an opposing back face that extend between the top and bottom surfaces, and a pair of opposing side faces that extend between the top and bottom surfaces, the exchanger snout projecting from the front face of the housing and being elongated so as to have a greater width than height, the exchanger snout being positioned under the carpet;

a seal mounted on the housing, the seal having an inside edge that bounds an opening that is in alignment with the inlet port; and a heat exchanger at least partially disposed within the chamber of the housing such that air blown from inlet port to the outlet port is passed by the heat exchanger; and a portable centrifugal air mover comprising a body, an air inlet, and a snout projecting from the body, the air mover being adapted to draw air in through the air inlet and blow the air out through the snout, the centrifugal air mover being removably coupled with the heat exchanger assembly so that the snout extends through the inlet port and into the chamber of the housing, at least a portion of the snout being freely disposed within the chamber of the housing so that the snout is aligned with the heat exchanger at an oblique angle, the snout forcing the seal to bend into the chamber and bias against the snout so that when air is passed from the air mover into the chamber air pressure created within the chamber pushes the seal against the snout.

32. The portable carpet drying system of claim 31, wherein the centrifugal air mover is blowing air at a rate between 2,000-3,500 cubic feet per minute (cfm).

33. The portable carpet drying system of claim 31, further comprising a carpet clamp mounted on the housing of the heat exchanger assembly, the carpet clamp being secured to the carpet.

34. The portable carpet drying system of claim 31, wherein the snout extends through the inlet port and into the chamber of the housing at an oblique angle relative to the bottom surface of the housing.

35. The portable carpet drying system of claim 31, wherein the air exiting the snout passes through the heat exchanger at an oblique angle.

* * * * *

UNITED STATES PATENT AND TRADEMARK OFFICE

CERTIFICATE OF CORRECTION

PATENT NO. : 8,789,291 B2
APPLICATION NO. : 11/221435
DATED : July 29, 2014
INVENTOR(S) : Reets et al.

It is certified that error appears in the above-identified patent and that said Letters Patent is hereby corrected as shown below:

In the Specification

Column 1
Line 63, change "using a air mover" to --using an air mover--
Line 65, change "a air mover" to --an air mover--
Line 66, change "a air mover" to --an air mover--

Column 4
Line 42, change "can simply a sheet" to --can simply be a sheet--
Line 59, change "other alternatively shapes" to --other alternative shapes--

Column 7
Line 12, change "outlet end outlet end 128" to --outlet end 128--

Column 8
Line 35, change "are is disposed" to --are disposed--

Column 9
Line 30, change "wetted carpet paid" to --wetted carpet pad--
Line 61, change "range between about of" to --range between about--

Column 10
Line 41, change "housing 203" to --housing 206--
Line 43, change "housing 203" to --housing 206--

Signed and Sealed this
Twenty-first Day of July, 2015

Michelle K. Lee

Michelle K. Lee
*Director of the United States Patent and Trademark Office*